US008553844B2

(12) United States Patent
Lewalter et al.

(10) Patent No.: US 8,553,844 B2
(45) **Date of Patent: *Oct. 8, 2013**

(54) HYBRID DESIGN OF AN ANODE DISK STRUCTURE FOR HIGH PROWER X-RAY TUBE CONFIGURATIONS OF THE ROTARY-ANODE TYPE

(75) Inventors: Astrid Lewalter, Aachen (DE); Rainer Pietig, Herzogenrath (DE); Albert Langkamp, Dresden (DE); Heiko Richter, Bautzen (DE); Thomas Behnisch, Leckwitz (DE); Werner Hufenbach, Dresden (DE); Rolf Karl Otto Behling, Norderstedt (DE); Christoph Bathe, Hamburg (DE)

(73) Assignee: Koninklijke Philips N.V., Eindhoven (NL)

( * ) Notice: Subject to any disclaimer, the term of this patent is extended or adjusted under 35 U.S.C. 154(b) by 531 days.

This patent is subject to a terminal disclaimer.

(21) Appl. No.: 12/673,510

(22) PCT Filed: Aug. 12, 2008

(86) PCT No.: PCT/IB2008/053225

§ 371 (c)(1), (2), (4) Date: Feb. 14, 2011

(87) PCT Pub. No.: WO2009/022292

PCT Pub. Date: Feb. 19, 2009

(65) Prior Publication Data

US 2011/0129068 A1 Jun. 2, 2011

(30) Foreign Application Priority Data

Aug. 16, 2007 (EP) ..... 07114454

(51) Int. Cl.
*H01J 25/26* (2006.01)
*H01J 35/00* (2006.01)

(52) U.S. Cl.
USPC ..... 378/127; 378/125; 378/132

(58) Field of Classification Search
USPC ..... 378/128, 129, 132, 133, 144
See application file for complete search history.

(56) References Cited

U.S. PATENT DOCUMENTS 3,710,170 A 1/1973 Friedel
3,751,702 A * 8/1973 Dietz ..... 378/125

(Continued)

FOREIGN PATENT DOCUMENTS

DE 2816116 10/1978
DE 3238352 A1 4/1984

(Continued)

*Primary Examiner* — Hoon Song
*Assistant Examiner* — Danielle Fox

(57) ABSTRACT

This invention relates to high power X-ray sources, in particular to those equipped with a rotating X-ray anode capable of delivering a higher short time peak power than conventional rotating x-ray anodes. This invention can overcome the thermal limitation of peak power by allowing fast rotation of the anode and by introducing a lightweight material with high thermal conductivity in the region adjacent to the focal track material. The fast rotation can be provided by using sections of the rotating anode disk made of anisotropic high specific strength materials with high thermal stability that can be specifically adapted to the high stresses of anode operation. Uses include high speed image acquisition for X-ray imaging, for example, of moving objects in real-time such as in medical radiography.

14 Claims, 8 Drawing Sheets

(56) References Cited

U.S. PATENT DOCUMENTS

| | | | | |
|---|---|---|---|---|
| 3,836,804 | A | 9/1974 | Frens et al. | |
| 4,145,632 | A | 3/1979 | Devine, Jr. | |
| 4,344,012 | A | 8/1982 | Hubner et al. | |
| 4,392,238 | A | 7/1983 | Lersmacher et al. | |
| 4,597,095 | A | 6/1986 | Akpan | |
| 4,847,883 | A * | 7/1989 | Fourre | 378/144 |
| 4,958,364 | A | 9/1990 | Guerin et al. | |
| 5,875,228 | A | 2/1999 | Truszkowska | |
| 6,160,868 | A | 12/2000 | Snyder et al. | |
| 6,252,937 | B1 | 6/2001 | Snyder | |
| 6,256,376 | B1 | 7/2001 | Benz et al. | |
| 2005/0226387 | A1 | 10/2005 | Tiearney, Jr. et al. | |
| 2007/0071174 | A1 | 3/2007 | Hebert et al. | |

FOREIGN PATENT DOCUMENTS

| | | | |
|---|---|---|---|
| DE | 19650061 | A1 | 6/1997 |
| EP | 0323366 | A1 | 7/1989 |
| EP | 0913854 | | 5/1999 |
| FR | 2496981 | A1 | 6/1982 |
| FR | 2500958 | | 9/1982 |
| JP | 63124352 | A | 5/1988 |
| JP | 08250053 | A | 9/1996 |
| JP | 9207552 | A | 8/1997 |
| JP | 2002329740 | A1 | 11/2002 |

* cited by examiner

Frontal view

Cross-sectional side view

Frontal view

Cross-sectional side view

HYBRID DESIGN OF AN ANODE DISK STRUCTURE FOR HIGH PROWER X-RAY TUBE CONFIGURATIONS OF THE ROTARY-ANODE TYPE

The present invention is related to high power X-ray sources, in particular to X-ray tube configurations which are equipped with rotary anodes capable of delivering a much higher short time peak power than conventional rotary anodes according to the prior art which are for use in conventional X-ray sources. The herewith proposed design principle thereby aims at overcoming thermal limitation of peak power by allowing extremely fast rotation of the anode and by introducing a lightweight material with high thermal conductivity in the region adjacent to the focal track material. Such a high-speed rotary anode disk can advantageously be applied in X-ray tubes for material inspection or medical radiography, for X-ray imaging applications which are needed for acquiring image data of moving objects in real-time, such as e.g. in the scope of cardiac CT, or for any other X-ray imaging application that requires high-speed image data acquisition. The invention further refers to a high-speed rotary anode design with a segmented anode disk.

BACKGROUND OF THE INVENTION

In current CT systems, an X-ray tube mounted on a gantry rotates about the longitudinal axis of a patient's body to be examined while generating a cone beam of X-rays. A detector system, which is mounted opposite to the X-ray tube on said gantry, rotates in the same direction about the patient's longitudinal axis while converting detected X-rays, which have been attenuated by passing the patient's body, into electrical signals. An image rendering system running on a workstation then reconstructs a planar reformat image, a surface-shaded display or a volume-rendered image of the patient's interior from a voxelized volume dataset.

Unfortunately, more than about 99% of the power which is applied to an X-ray tube is converted into heat. Efficient heat dissipation thus represents one of the greatest challenges faced in the development of current high power X-ray tubes. Given its importance with respect to the functioning and service life of an X-ray tube as a whole, the anode is usually the prime subject of the tube design.

Compared to stationary anodes, X-ray tubes of the rotary-anode type offer the advantage of distributing the thermal energy which is deposited onto the focal spot across the larger surface of a focal track. This permits an increase in power for short operation times. However, as the anode is now rotating in a vacuum, the transfer of thermal energy to the outside of the tube envelope depends largely on radiation, which is not as effective as the liquid cooling used in stationary anodes. Rotating anodes are thus designed for high heat storage capacity and for good radiation exchange between anode and tube envelope. Another difficulty associated with rotary anodes is the operation of a bearing system under vacuum and the protection of this system against the destructive forces of the anode's high temperatures.

In the early days of rotary anode X-ray tubes, limited heat storage capacity of the anode was the main hindrance to high tube performance. This has changed with the introduction of the following new technologies: Graphite blocks brazed to the anode dramatically increase heat storage capacity and heat dissipation, liquid anode bearing systems (sliding bearings) provide heat conductivity to a surrounding cooling oil, and rotating envelope tubes allow direct liquid cooling for the backside of the rotary anode.

Tungsten has been developed as a standard target material in a plurality of X-ray tube anodes designed for medical applications. The anode disks of rotary anode tubes usually include a 1 to 2 mm thin layer of a tungsten-rhenium (W/Re) alloy deposited onto a main body which is made mainly of refractory metals, e.g. of molybdenum (Mo). The rhenium increases the ductility of the tungsten, reduces thermo-mechanical stress and increases anode service life thanks to a slower roughening of the anode surface. The ideal commercial and technological alloy has been determined to be composed of 5 to 10% rhenium (Re) and 90 to 95% tungsten (W).

As mentioned, the introduction of graphite blocks brazed to the backside of the molybdenum body represents an advance in rotary anode technology. The graphite block in this design significantly increases the heat storage capacity of the anode, while requiring only a slight increase in overall anode weight. Moreover, heat dissipation is accelerated by the larger anode surface and the superior emission coefficient of graphite compared to molybdenum. Molybdenum and graphite may be brazed together with zirconium (Zr) or, for higher operating temperatures, with titanium (Ti) or other specially designed brazing alloys.

In order to avoid damage caused by thermal stress, which is due to impinging electrons that provide for a heating of the anode, and to prevent evaporation of material, it is important to have access to information on the temperature of the anode base, the focal track and the focal spot.

The anode disk temperature can be derived from the equilibrium of the power P supplied by the electrons, the power $P_{Rad}$ dissipated by radiation and the power $P_{Cond}$ dissipated by thermal conduction:

$$\begin{aligned} P_{Anode} &= P - P_{Rad} - P_{Cond} \\ &= \frac{d}{dt} \cdot \sum_i Q_i(T) = \frac{dT}{dt} \cdot \sum_i C_i(T) \\ &= \frac{dT}{dt} \cdot \sum_i c_i(T) \cdot m_i [W]. \end{aligned} \tag{1}$$

In this equation, subscript i is used to account for the various materials in anodes which are composed of several components, such as e.g. metallic disks, graphite rings and other materials, $Q_i(T)=T \cdot C_i(T)$ [J] denotes the amount of heat energy absorbed by the individual anode components i as a function of temperature T (in K), $C_i(T)=c_i(T) \cdot m_i$ $[J \cdot K^{-1}]$ denotes the heat capacity of said anode components i as a function of said temperature T, and $c_i(T)$ $[J \cdot K^{-} \cdot g^{-1}]$ and $m_i$ [g] denote the specific heat capacity and the mass of said components, respectively, with $c_i$ being a function of the temperature T. As described by the Stefan-Boltzmann law, the anode disk dissipates its heat power largely via thermal radiation:

$$P_{Rad} = \sigma \cdot (T_{Anode}^4 - T_{Envelope}^4) \cdot \sum_i A_i(T) \cdot S_i [W], \tag{2a}$$

wherein $T_{Anode}$ and $T_{Envelope}$ respectively denote the temperatures of the anode disk and of the envelope, $A_i(T)$ is the anode absorption factor of anode component i as a function of temperature T on the surface area $S_i$ of this anode component, proportionality factor $$\sigma = \frac{2\pi^5 \cdot k^4}{15c^2 \cdot h^3} \approx 5.670400 \cdot 10^{-8} W \cdot m^{-2} \cdot K^{-4} \tag{2b}$$

denotes the Stefan-Boltzmann constant, $k \approx 1.38066 \cdot 10^{-23}$ $J \cdot K^{-1}$ denotes the Boltzmann constant, $c \approx 2.99792458 \cdot 10^8$ $m \cdot s^{-1}$ is the speed of light in a vacuum, and $h \approx 6.6260693 \cdot 10^{-34}$ Js$\approx 4.13566743 \cdot 10^{-15}$ eVs is Planck's constant.

In the case of anodes with liquid metal bearings, a noticeable part of the anode heat is also dissipated by the liquid metal via thermal conduction. In this context, it should be noted that the efficiency of the dissipation depends on thermal conductivity constant $\kappa$ [$W \cdot m^{-2} \cdot K^{-1}$] of the X-ray tube, bearing surface $S_B$ [$m^2$] and the temperature difference between the temperature $T_{Anode}$ [K] of the anode disk and the temperature $T_{Oil}$ [K] of the cooling oil:

$$P_{Cond} = \kappa \cdot S_B \cdot (T_{Anode} - T_{Oil})[W]. \tag{2c}$$

The temperature of the focal spot, however, is significantly higher than the temperature of the anode disk. The temperature rise $\Delta\theta_{short}$ for short load times of less than 0.05 s for standard focal spot dimensions can be approximated by $$\Delta\vartheta_{short} = \frac{2P}{A_F} \cdot \sqrt{\frac{\Delta t_{Load}}{\pi \cdot \lambda \cdot \rho \cdot c}}\ [K], \tag{3a}$$

wherein P [W] denotes the power input, $A_F = 2\delta \cdot l$ [$mm^2$] denotes the area of the focal spot, $\Delta t_{Load}$ [s] is the load period, $\lambda$ [$W \cdot mm^{-1} \cdot K^{-1}$] denotes the thermal conductivity, c [$J \cdot K^{-1} \cdot g^{-1}$] denotes the specific heat capacity and $\rho$ [$g \cdot mm^{-3}$] is the mass density of the focal track material, and the temperature rise $\Delta\theta_{long}$ for long loading times can be approximated by $$\Delta\vartheta_{long} = \frac{P \cdot \delta}{A_F \cdot \lambda}[K], \tag{3b}$$

wherein $\delta$ [mm] denotes the focal spot half width.

While in the case of stationary anodes load period $\Delta t_{Load}$ in equation (3a) corresponds to the period in which the load is applied, it is necessary to replace this factor in the case of rotary anodes by an interval $\Delta t_{Load}'$ in order to describe the time period in which a point on the focal track is hit by the electron beam during one revolution of the anode:

$$\Delta t'_{Load} = \frac{\delta}{\pi \cdot R \cdot f}[s], \tag{4}$$

Thereby, R [mm] denotes the focal track radius and f [Hz] is the anode rotation frequency. Using the temperature rise at the focal spot of a rotary anode, which—by substituting $\Delta t_{Load}$ in equation (3a) by $\Delta t_{Load}'$ from equation (4)—can be approximated by $$\Delta\vartheta_{Focus} = \frac{2P}{A_F} \cdot \sqrt{\frac{\delta}{\pi^2 \cdot R \cdot \lambda \cdot \rho \cdot c \cdot f}}\ [K], \tag{5a}$$

and the temperature rise $$\Delta\vartheta_{Track} = k \cdot \Delta\vartheta_{Focus} \cdot \sqrt{\frac{\delta}{\pi \cdot R} \cdot (n+1)}\ [K], \tag{5b}$$

of the focal track on the target, said focal track being formed by the multitude of all surface elements heated by the electron beam and being visible on used targets as a highly roughened circle, wherein k denotes a factor accounting for anode thickness, thermal radiation and radial heat diffusion and $n = \Delta t_{Load} \cdot f$ denotes the number of revolutions during time $\Delta t_{Load}$, the anode power necessary to achieve the total focal spot temperature rise $\Delta\theta = \Delta\theta_{Track} + \Delta\theta_{Focus}$ can be obtained as $$P = \frac{\pi \cdot \Delta\vartheta \cdot l \cdot \sqrt{\lambda \cdot \rho \cdot c \cdot \delta \cdot R \cdot f}}{1 + k \cdot \sqrt{\frac{\delta}{\pi \cdot R} \cdot \Delta t_{Load} \cdot f}}[W] \tag{6}$$

by combining equations (5a) and (5b) as given above, wherein l [mm] denotes the focal spot length.

If X-ray imaging systems, such as computed tomography (CT) systems or others, are used to depict moving objects, high-speed image generation is typically required so as to avoid occurrence of motion artefacts. An example would be a CT scan of the human heart (cardiac CT): In this case, it would be desirable to perform a full CT scan of the myocard with high resolution and high coverage within less than 100 ms, this is, within the time span during a heart cycle while the myocard is at rest. High-speed image generation requires high peak power of the respective X-ray source. Conventional X-ray sources used for medical or industrial X-ray imaging systems are usually realized as X-ray tubes in which a focused electron beam that is emitted by a cathode within a high vacuum tube is accelerated onto an anode by a high voltage of roughly up to 150 kV. In the small focal spot on the anode, X-rays are generated as bremsstrahlung and characteristic X-rays. Conversion efficiency from electron beam power to X-ray power is low, at maximum between about 1% and 2%, but in many cases even lower. Consequently, the anode of a high power X-ray tube carries an extreme heat load, especially within the focus (an area in the range of about a few square millimeters), which would lead to the destruction of the tube if no special measures of heat management are taken. Commonly used thermal management techniques for X-ray anodes include:

- using materials that are able to resist very high temperatures,
- using materials that are able to store a large amount of heat, as it is difficult to transport the heat out of the vacuum tube,
- enlarging the thermally effective focal spot area without enlarging the optical focus by using a small angle of the anode, and
- enlarging the thermally effective focal spot area by rotating the anode.

Especially the last point is the most effective: The higher the velocity of the focal track with respect to the electron beam, the shorter the time during which the electron beam deposits its power into the same small volume of material and thus the lower the resulting peak temperature. High focal track velocity is accomplished by designing the anode as a rotating disk with a large radius (e.g. 10 cm) and rotating this disk at a high frequency (e.g. more than 150 Hz). Obviously, the radius and rotational speed of the anode are limited by the centrifugal force. The mechanical stresses within a rotating disk as described above are roughly proportional to $\rho \cdot r^2 \cdot \omega^2$, wherein $\rho$ [$g \cdot cm^{-3}$] denotes the density of the applied anode disk material, r [cm] is the radius and $\omega$ [$rad \cdot s^{-1}$] the rotational frequency of the anode disk. The focal track speed $v_{FT}$ [$cm \cdot s^{-1}$] is proportional to $r \cdot \omega$. Therefore, an increase of focal track speed $v_{FT}$ would result in an increase of mechanical stresses in the anode disk, which would eventually crack the anode disk. Current high power X-ray tubes are mostly made of refractory metals. On one hand, refractory metals, such as e.g. tungsten (W) or molybdenum (Mo), have a high atomic number and provide a higher X-ray yield. Therefore, they are needed at the focal track. On the other hand, these materials feature a high mechanical strength and a high thermal stability. At the same time, the large anodes provide a big thermal "mass" for heat storage. The thermal design is a compromise between heat storage and heat distribution. But even though these anodes are operated at the highest possible rotational speed, their maximum peak power is not enough to meet the requirements for imaging moving objects such as e.g. the human myocard without motion artefacts.

FR 2 496 981 A is related to an X-ray tube's rotary anode whose surface of impact for impinging electrons is on a metal ring which is fixed on a graphite body at the axis of rotation. According to an embodiment of the herein disclosed invention, a metal hub, which serves as a connection element, is attached between the graphite body and the rotational axis. According to a further embodiment of the invention described in this reference document, the graphite body is subdivided into 10 to 12 distinct anode sectors.

In US 2007/0 071 174 A1 an X-ray target is described which comprises a composite graphite material operably coupled to an X-ray target cap. The aforementioned composite graphite material varies spatially in thermal properties, and in some embodiments, in strength properties. In some embodiments, the spatial variance is a continuum and in other embodiments, the spatial variance is a plurality of distinct portions.

JP 08 250 053 A describes an X-ray tube rotary anode (rotary target) that can simultaneously obtain high specific strength and high heat conduction. It is provided with a base material for laminating a unidirectional carbon-carbon fiber compound material having a thickness of 1.0 mm thick or less, a tensile strength of 500 MPa or more in a fiber axial direction and having a heat conductivity of 200 $W \cdot m^{-1} \cdot K^{-1}$ or more and is further provided with three layers or more in a rotary axial direction so as to have pseudo isotropy. An X-ray generating layer consisting of tungsten or a tungsten alloy is provided on one surface of the base material. This base material thereby features a heat conductivity of 200 $W \cdot m^{-1} \cdot K^{-1}$ or more in a surface direction.

JP 2002/329 470 A1 is directed to an X-ray tube's rotary anode which excels in thermal radiation nature, thermal shock resistance and large mechanical strength by which deformation of failure, breakage or the like can not take place easily, thus leading to a long service life. Furthermore, the herein described invention refers to a manufacturing method for fabricating such a rotary anode. In the manufacturing method of the rotary anode, surface processing and surface treatment are given so that surface roughness $R_{max}$ of all the jointed surfaces of the anode, which are made of tungsten or a rhenium-tungsten alloy, is about 3 μm or less, its degree of flatness is about 60 μm or less, surface roughness $R_{max}$ of all the jointed surface of the support side, made of molybdenum or a molybdenum alloy, is about 3 μm or less and its degree of flatness is about 20 μm or less. Further, graphite or a carbon fiber composite material, zirconium wax material, a disk of molybdenum or a molybdenum alloy (TZM, Mo—TiC) and a disk of tungsten or a rhenium-tungsten alloy are laminated in this order and joint to one body in conditions of a temperature between 1,600 and 1,800° C., a pressure between 15 and 35 MPa and holding times between 1 and 3 hours in a vacuum or inactive gas atmosphere generated by a hot pressing machine or a heat isotropic pressing machine.

U.S. Pat. No. 3,751,702 A refers to an X-ray tube of the rotating-anode type which includes a disk that is resiliently mounted upon a shaft and also contains an electron impinging portion thereupon. The disk is provided with recesses which lie on concentric circles on the axis of rotation, extend from both the upper and lower surfaces of the anode disk and at least penetrate partially through the thickness of the anode disk. Thus, the thermal connection between the axis of the anode disk and the electron impinging portion is somewhat elongated. Deformation stresses are moderated due to the fact that the anode disk is now somewhat resilient. Furthermore, greater temperature gradients can be endured without fracture of the anode disk.

SUMMARY OF THE INVENTION

The present invention overcomes the above-mentioned peak power limitation of conventional high power X-ray tubes as known from the prior art by a new design principle of the rotary anode disk, thereby involving a new material composition and a hybrid design. An X-ray anode built according to the present invention will rotate at a much higher frequency (e.g. at a rotation frequency of about 300 Hz) than current anodes while having a comparable or even larger radius. It will therefore generate a much higher relative speed of the focal track. A second disadvantage of conventional high power X-ray anodes, which has not been mentioned so far, lies in the fact that the refractory metals used as anode materials do not provide a high thermal conductivity. The anode design proposed by the present invention will not only allow faster rotation but also provide higher thermal conductivity close to the focal track. Therefore, the present invention will allow for a breakthrough in peak power capability of the X-ray tube in order to enable high speed imaging of moving objects without motion artefacts.

To solve this object, the present invention proposes a new design principle for rotating X-ray anodes capable of delivering a much higher short time peak power than conventional rotating X-ray anodes known from the prior art. The herewith proposed design principle thereby aims at overcoming thermal limitation of peak power by allowing extremely fast rotation of the anode and by introducing a lightweight material with high thermal conductivity in the region adjacent to the focal track material. The extremely fast rotation is enabled by providing sections of the rotary anode disk made of anisotropic high specific strength materials which will be specifically adapted to the high stresses building up when the anode is operated, e.g. fiber-reinforced ceramic materials. An X-ray system that is equipped with a high peak power anode according to the present invention will be capable of high speed image acquisition with high resolution and high coverage, which is e.g. needed for computed tomography of moving objects, for example in cardiac CT.

As already mentioned above, the new design principle for high power X-ray anodes proposed by the present invention reflects the understanding of the inventors that the main requirement for an X-ray tube suitable for high-speed imaging of moving objects is not its mean power but its (short-time) peak power capability. For example, if a full CT scan of the myocard could be accomplished in 100 ms or less, the required peak power is extremely high, but the total heat load deposited in the anode is the same or even less as for a conventional cardiac CT scan. It could be less, in fact, since only relevant images during the rest phase of the myocard within one heart cycle need to be taken, while conventional CT imaging of the heart requires scanning at least one, but mostly multiple heart cycles.

Therefore, the thermal design no longer needs a large thermal "mass" but has to fully concentrate on quick heat distribution. Furthermore, the main needs—high thermal conductivity and high mechanical strength for extremely fast rotation—need no longer be combined within the same material. The anode needs a very strong frame that sustains fast rotation and high thermal conductivity close to the focal track. The present invention therefore proposes a tailored hybrid design of the rotary anode. The main features of the proposed anode can be summarized as follows: First, it should be mentioned that only lightweight materials are used so as to lower centrifugal forces (proportional to the density). Moreover, an anode disk having a large radius of 10 cm and more is applied. The anode disk may thereby comprise at least one section with high thermal conductivity as well as at least one section of high mechanical strength and stability that provide a strong frame. For fabricating the anode disk, several materials can be used, but at least those that come close to the focal track must have high thermal stability so as to be able to resist high temperatures. According to the hybrid anode disk design proposed by an exemplary embodiment of the present invention, this high mechanical strength may e.g. be provided by high specific strength materials (this is, materials with a high ratio of structural strength compared to their density), which have anisotropic material properties that will be specifically designed according to the distribution of stress load within the rotary anode due to the extremely fast rotation and thermal expansion. The high specific strength materials that also offer high thermal stability and designable anisotropic material properties could be fiber-reinforced ceramics, such as e.g. carbon fiber-reinforced carbon (CFC), silicon carbide fiber-reinforced silicon carbide (SiC/SiC) or other reinforced ceramic materials. Thereby, fiber orientation can be specifically designed to sustain extreme stress loads. The materials with high thermal conductivity and at the same time high thermal stability and low density could e.g. be special graphite materials which have been designed for high thermal conductivity.

According to a further embodiment of the present invention, the rotary anode disk may have a symmetric design with respect to the rotational plane of the rotary anode disk. This has the advantage that a bending of the anode disk under rotation is avoided. A further advantage is that this anode could be operated with two different focal tracks, thus being able to switch the focus position, which could be beneficial for some imaging applications.

According to a still further embodiment of the present invention, the rotary anode disk may be characterized by a non-constant, decreasing profile thickness in radial direction. This has the advantage of a better stress distribution and reduces the maximum stresses.

According to a still further embodiment of the present invention, the rotary anode disk may comprise an additional region that is made of a material of type "frame material" in the section adjacent to the focal track. This results in additional stability of the whole anode design.

According to a still further embodiment of the present invention, the rotary anode disk's inner frame section is designed as a spoke wheel. This implies the advantage of an overall weight reduction and thus a reduction of centrifugal force. Furthermore, the quasi-1D structure of the spokes is especially suitable for reinforcement with radially oriented fibers.

According to a still further embodiment of the present invention, the rotary anode disk may e.g. be characterized by slits going from the outer edge of the anode disk to the inner anode bulk, which helps to reduce the occurring tangential stress. Moreover, for a design variation with slits, additional regions with "frame material" could be introduced at the borders of the resulting segments in order to reinforce the segment structure.

Another exemplary embodiment of the present invention is related to an X-ray tube's high-speed rotary anode featuring an outer frame section which serves as a key supporting structure that surrounds the inner anode sections. This outer frame section, which may e.g. be made of carbon fiber, a carbon-fiber reinforced material or any other fiber-reinforced high-specific strength and highly thermally stable material, thereby serves as the main mechanical support for the inner anode part.

According to a first refinement of this exemplary embodiment, a segmented anode disk structure is proposed where the inner anode sections (including the focal track) may e.g. be segmented by S-shaped slits of a constant width, said slits ranging from the inner anode bulk to the inner radial edge of the rotary anode disk's outer frame section. In this connection, it is proposed that the particular anode segments are at least partially connected to the outer frame section and are designed in such a way that radial heat expansion is absorbed by conversion into an allowable torsion of the segments.

A further refinement of this exemplary embodiment is directed to a high-speed rotary anode disk featuring an outer frame section as described above, wherein the anode additionally comprises a liquid metal heat conductor providing a liquid metal connection between the anode disk and the anode axis. This results in radial heat conduction and forceless expansion of the anode disk.

A still further refinement of this exemplary embodiment is directed to a high-speed rotary anode disk featuring an outer frame section as described above, wherein said anode additionally comprises a sliding radial connection between the anode disk and the anode's rotary shaft as well as a flexible heat conductor which connects the anode disk with the anode's rotary shaft via fixed joints that are attached to the anode disk or the rotary shaft, respectively. This consequently leads to the benefit of avoiding radial heat-induced forces while still providing good heat conduction between the anode disk and the rotary shaft. It is further proposed that the flexible heat conductor may e.g. be realized as a single copper wire or as a bundle of different copper wires.

According to a still further embodiment, the present invention is related to an X-ray tube of the rotary anode type which comprises a hybrid rotary anode disk as described above.

Finally, the present invention further refers to a computed tomography device that comprises such an X-ray tube.

BRIEF DESCRIPTION OF THE DRAWINGS

Advantageous features, aspects, and advantages of the invention will become evident from the following description, the appended claims and the accompanying drawings. Thereby.

DETAILED DESCRIPTION OF THE PRESENT INVENTION

In the following, the hybrid anode of the present invention will be explained in more detail with respect to special refinements and referring to the accompanying drawings.

Figure 1:
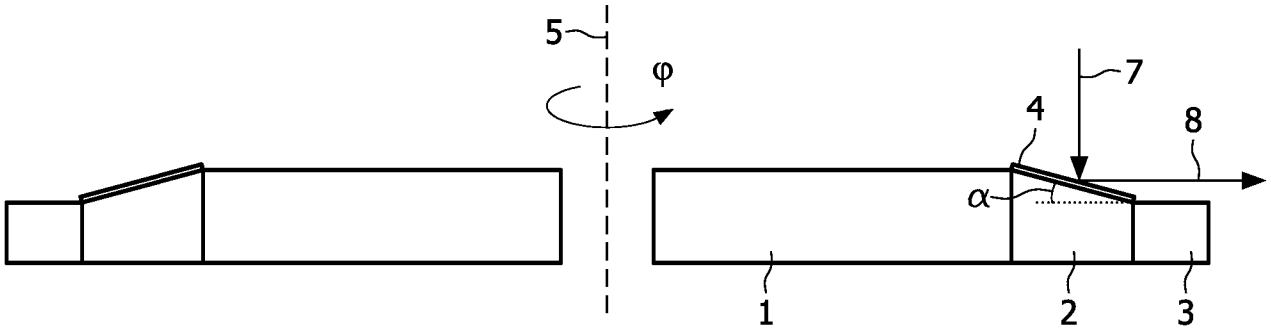
FIG. 1 shows a design cross section (profile) of a novel rotary anode disk according to an exemplary embodiment of the present invention, said anode disk comprising an inner frame section and an outer frame section, made of at least one anisotropic high specific strength material with high thermal stability ("frame material"), and a region adjacent to the anode's focal track with said region being made of a lightweight (not reinforced) material with high thermal conductivity ("thermal material")

The basic exemplary embodiment of the present invention can be demonstrated by the design cross section of a rotary anode disk as depicted in FIG. 1. The proposed anode disk comprises two frame sections 1 and 3 made of anisotropic high specific strength materials with high mechanical strength and stability ("frame materials", such as e.g. fiber-reinforced ceramic materials), that are specifically adapted to the high stresses building up when the anode disk is operated at extremely high rotational speed and extremely high short time peak power. Section 4 is a coating layer for the focal track, made of a material with high X-ray yield, e.g. containing a high percentage of tungsten (W) as a "track material". Section 2 is made of a lightweight (not reinforced) material with high thermal conductivity ("thermal material") in the region adjacent to the focal track material 4. For example, this may be a graphite material that is especially designed for high thermal conductivity. A further characteristic of the "thermal material" is that its coefficient of thermal expansion is well adapted to the coefficient of thermal expansion of the "track material" into all directions. This could for example be realized with graphite as a "thermal material" and tungsten (W) or a tungsten-rhenium alloy (W/Re) as a "track material". The focal track layer could be very thin (adapted to the penetration depth of the electrons, roughly in the order of 10 μm). This allows for a direct contact between the zone of heat generation and the underlying material of section 2 with high thermal conductivity, thereby facilitating an effective heat transfer and a cooling of the focal spot. Thereby, said "track material" may e.g. be applied to the anode by a thin film coating technique, such as e.g. CVD (Chemical Vapor Deposition) or PVD (Physical Vapor Deposition). As an alternative, the track layer could be thicker, e.g. in the order of 100 μm to 1 mm. This would lead to a higher mechanical strength of the track layer, and the track layer could be applied to the anode by a technique that produces thicker coating layers, such as e.g. plasma spraying.

In FIG. 1, the radial declination angle of section 2, in the following also referred to as "anode angle", is denoted by $\alpha$. Reference numeral 5 stands for the axis of rotation, reference numeral 7 represents the electron beam impinging on the anode disk's focal track, and reference numeral 8 denotes the X-ray emission towards the X-ray window of the X-ray tube.

The "frame materials" may be specifically designed according to the anisotropic an inhomogeneous stress distribution within the rotary anode under high speed rotation as well as thermal loading. For this purpose, frame sections 1 and 3 in FIG. 1 could also be further subdivided for combining different materials within one section. For example, if the chosen "frame materials" are CFC materials, the fiber content, fiber orientation and fiber lay-up may be designed in such a way that maximum stability over the whole load cycle of the anode is given. As an example for the design of the fiber orientation, or in a more general fashion, of the optimization of the frame materials, it should be mentioned that rotating disks with a central bore tend to build up high tangential stresses at the inner radius. Therefore, it could be part of the material optimization to increase the mechanical strength in tangential direction, e.g. by strong tangential fibers, in this region.

In the following sections, further variation of the basic design depicted in FIG. 1 will be described. It should be noted that these design variations can also be combined for a specific anode design according to this invention. In the following figures, reference numerals 1 to 5 thereby have the same meaning as in FIG. 1.

Figure 2:
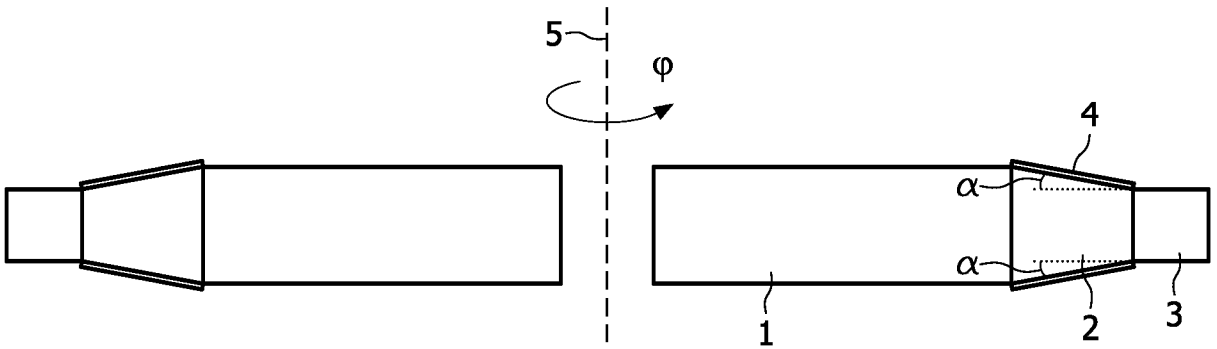
FIG. 2 shows a design variation of the rotary anode disk profile depicted in FIG. 1 with a symmetric design with respect to the rotational plane of the rotary anode disk.

In FIG. 2, a design variation of the rotary anode disk profile depicted in FIG. 1 with a symmetric design with respect to the rotational plane of the rotary anode disk is shown. This has the advantage that a bending of the anode disk under rotation is avoided. A further advantage is that this anode could be operated with two different focal tracks, thus being able to switch the focus position, which could be beneficial for some imaging applications. However, it is not necessary to provide two focal tracks in order to obtain a symmetric design of the anode with respect to its rotational plane. Any other means to balance the anode with respect to its rotational plane can be used to avoid bending of the anode disk under rotation.

Figure 3:
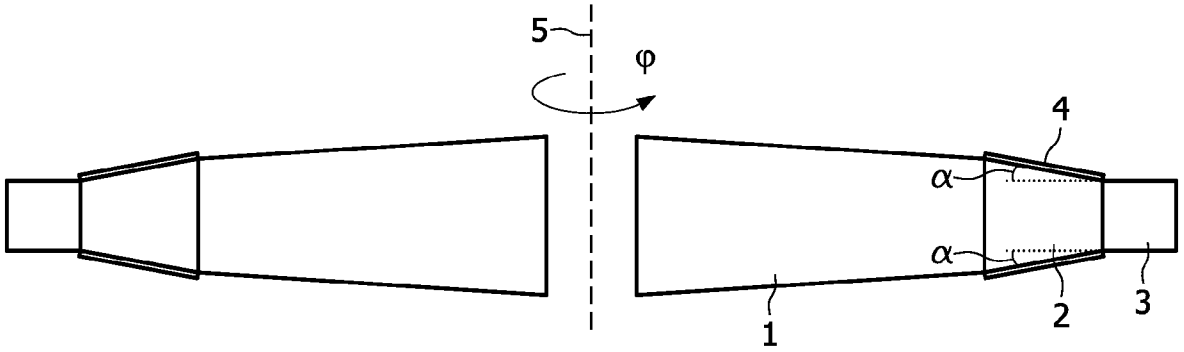
FIG. 3 shows a further design variation of the rotary anode disk profile depicted in FIG. 1, characterized by a non-constant, decreasing profile thickness in radial direction.

A further design variation of the rotary anode disk profile depicted in FIG. 1, which is characterized by a non-constant, decreasing profile thickness in radial direction, is shown in FIG. 3. The advantage is a better stress distribution, reducing the maximum stresses. It could be a conical profile as depicted in FIG. 3 or any other profile shape that reduces the maximum stress for the given material combinations.

Figure 4:
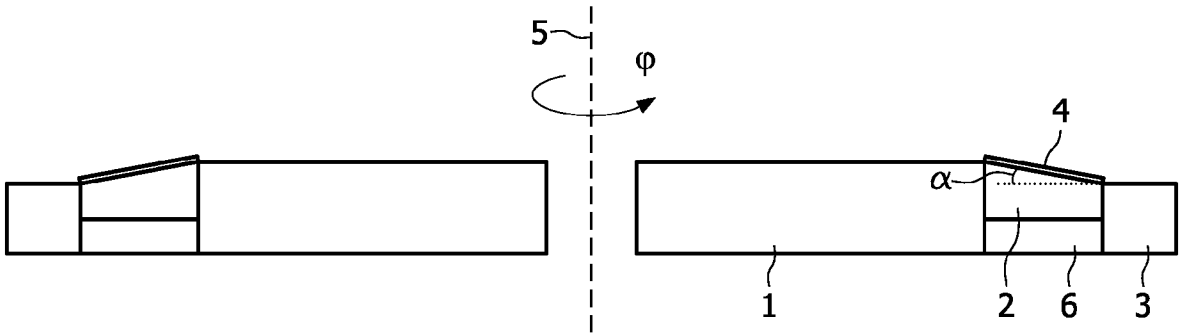
FIG. 4 shows a still further design variation of the rotary anode disk profile depicted in FIG. 1, characterized by an additional region that is made of said "frame material" in the section adjacent to the focal track.

FIG. 4 shows a still further design variation of the rotary anode disk profile depicted in FIG. 1, which is characterized by an additional region that is made of a material of type "frame material" in the section adjacent to the focal track. This results in additional stability of the whole anode design.

Figure 5:
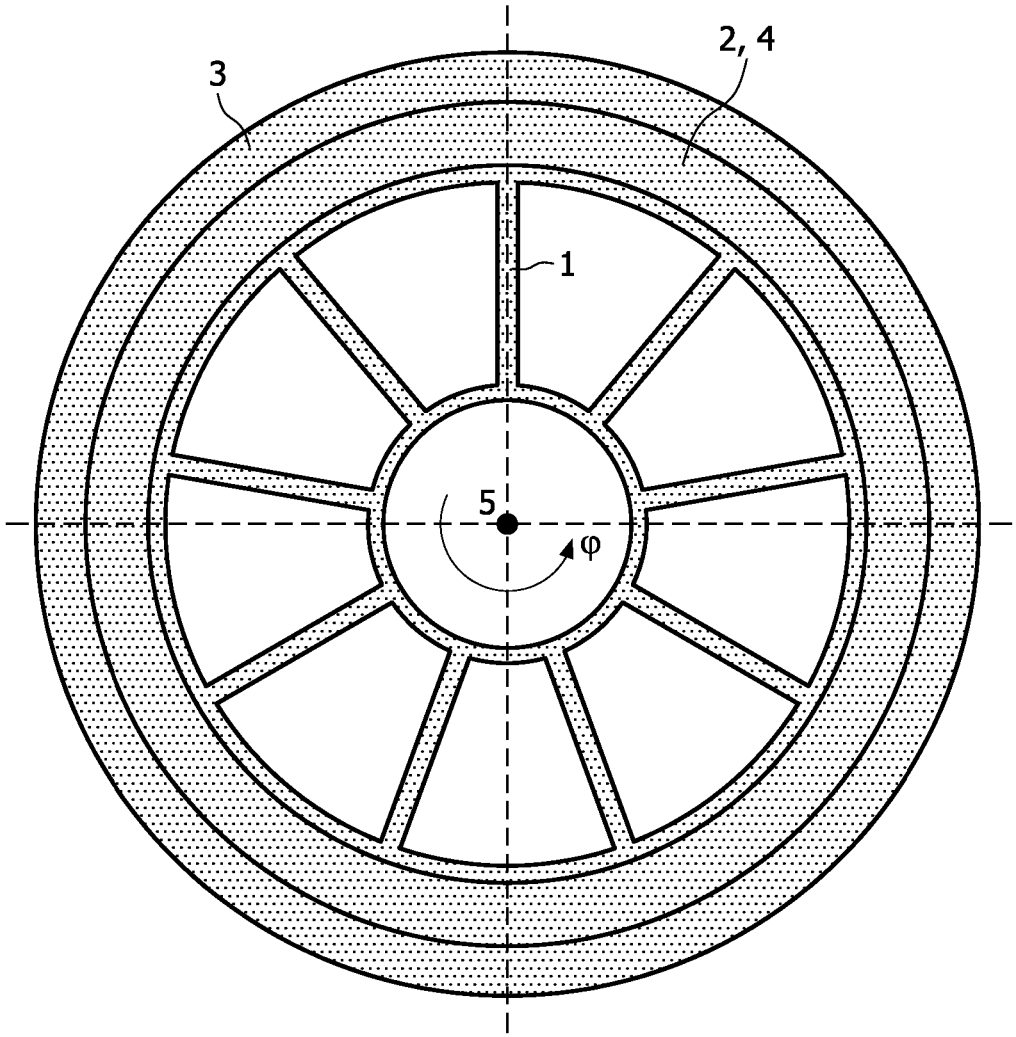
FIG. 5 shows a design variation of the rotary anode disk profile depicted in FIG. 1, characterized by an inner frame section being designed as a spoke wheel.

The design variation in FIG. 5 features the inner frame section designed as a spoke wheel. This implies the advantage of an overall weight reduction and thus a reduction of centrifugal force. Furthermore, the quasi-1D structure of the spokes is especially suitable for reinforcement with radially oriented fibers.

Figure 6:
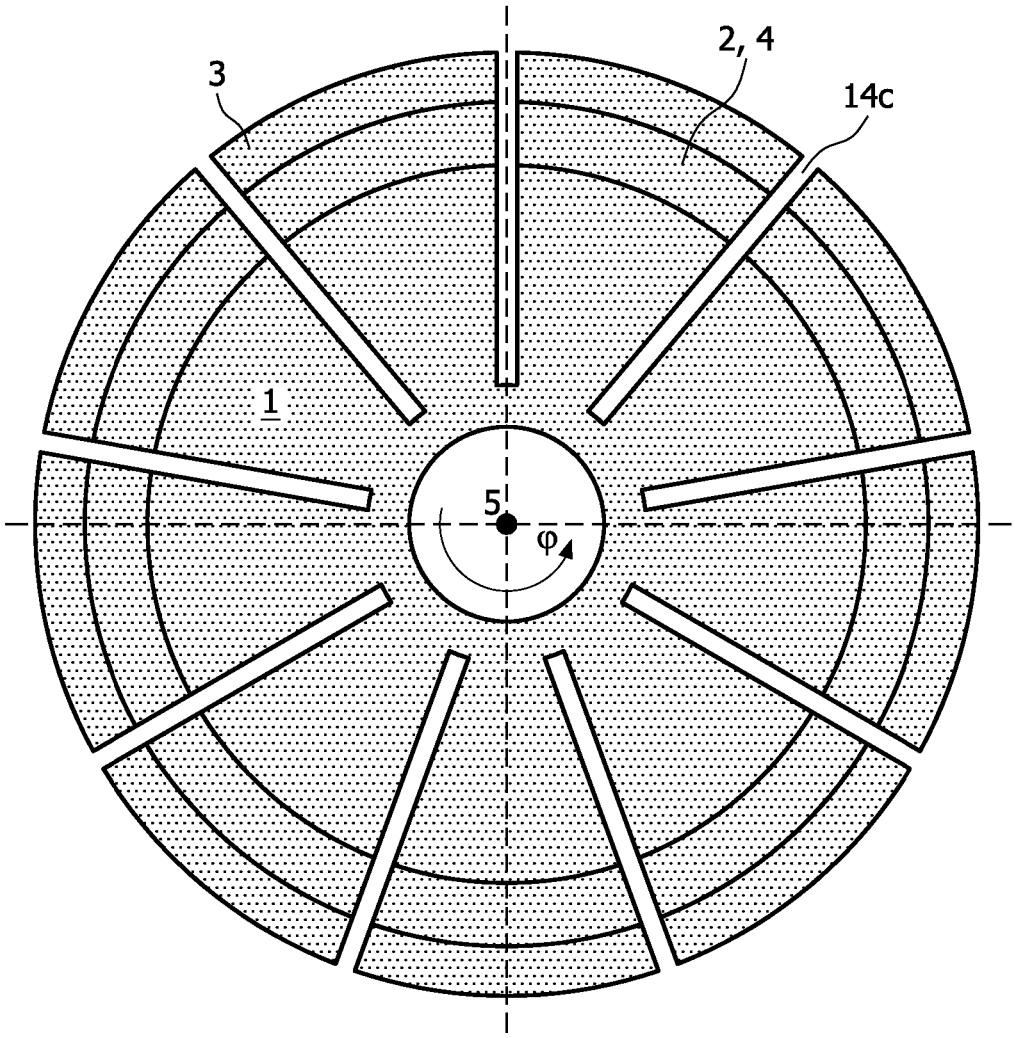
FIG. 6 shows a further design variation of the rotary anode disk profile depicted in FIG. 5, characterized by slits going from the outer edge of the anode disk to the inner anode bulk.

FIG. 6 shows a further design variation of the rotary anode disk profile as depicted in FIG. 5, which is characterized by slits going from the outer edge of the anode disk to the inner anode bulk. This helps to reduce the occurring tangential stress.

Figure 7:
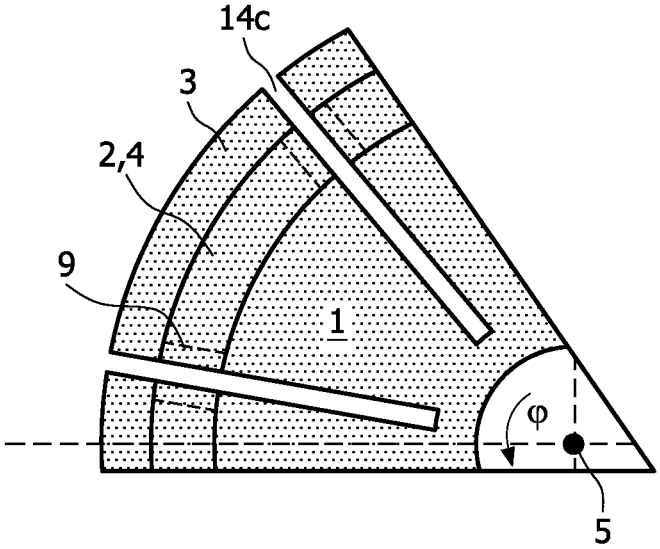
FIG. 7 shows a further design variation of the rotary anode disk profile depicted in FIG. 6, characterized by additional regions that are made of said "frame material" in the region adjacent to the focal track.

For a design variation with slits, additional regions with "frame material" could be introduced in section 2 at the borders of the resulting segments in order to reinforce the segment structure. In FIG. 7, an example for accommodating these additional regions 9 on the anode disk is shown.

Figure 8:
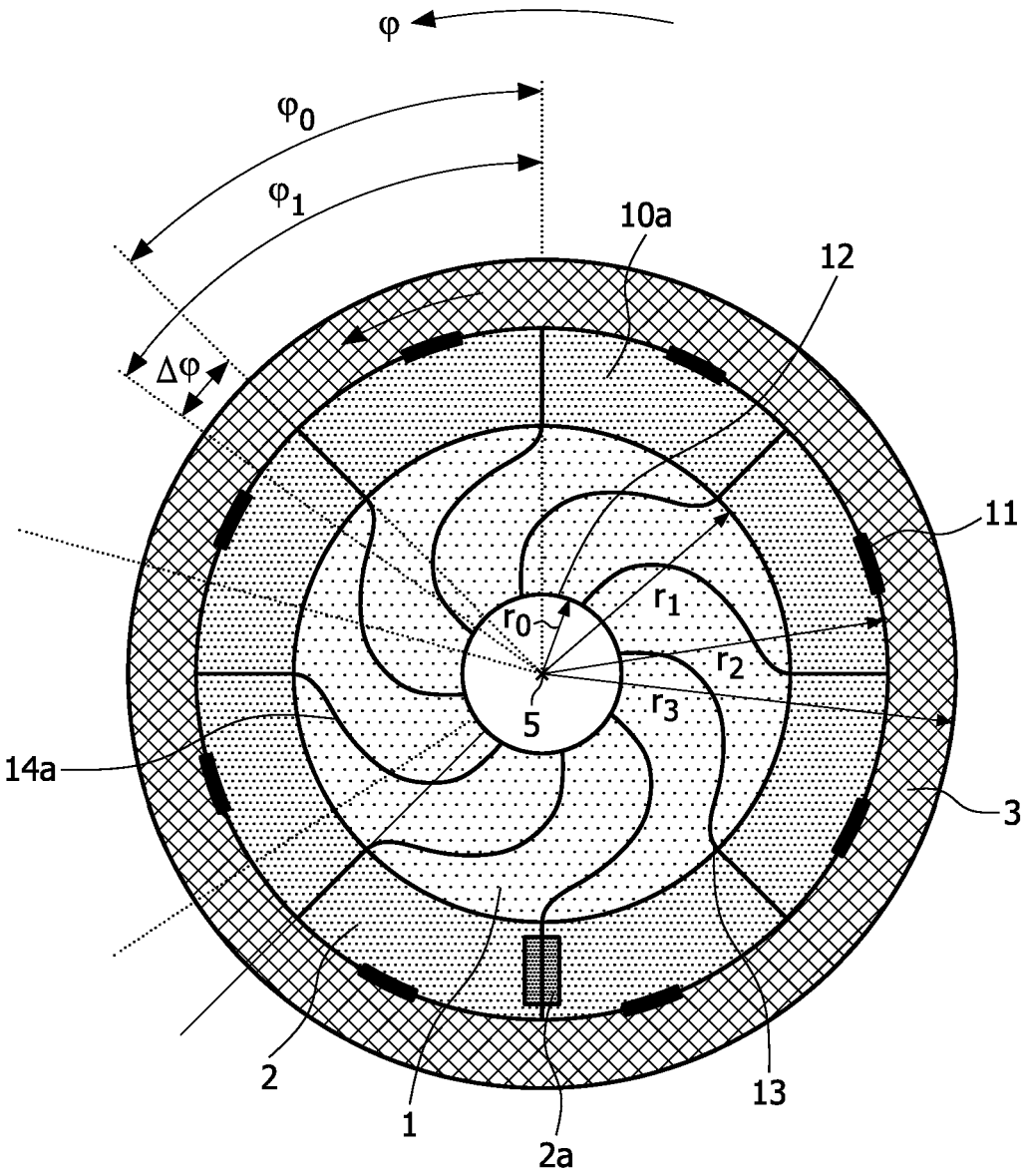
FIG. 8 shows a segmented rotary anode disk profile according to a further exemplary embodiment of the present invention, characterized by S-shaped slits between the particular segments of the anode disk.
Figure 9:
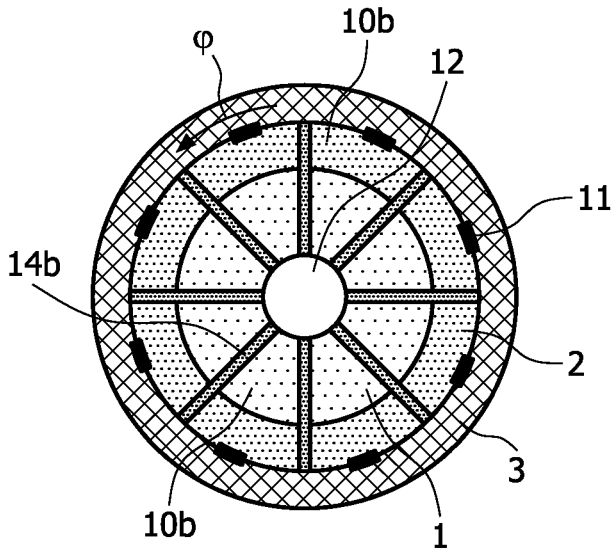
FIG. 9 shows a radial cross sectional view of the rotary anode disk profile according to a still further exemplary embodiment of the present invention, characterized by a liquid metal heat conductor.
Figure 9:
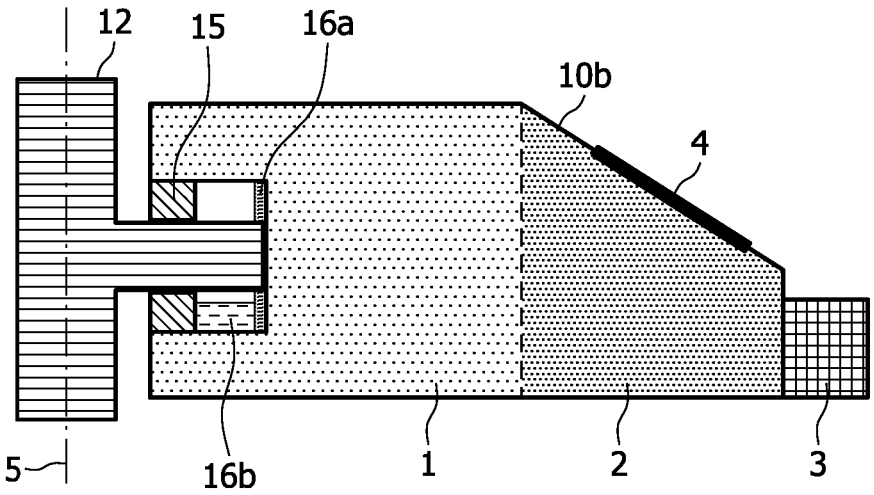
Figure 10:
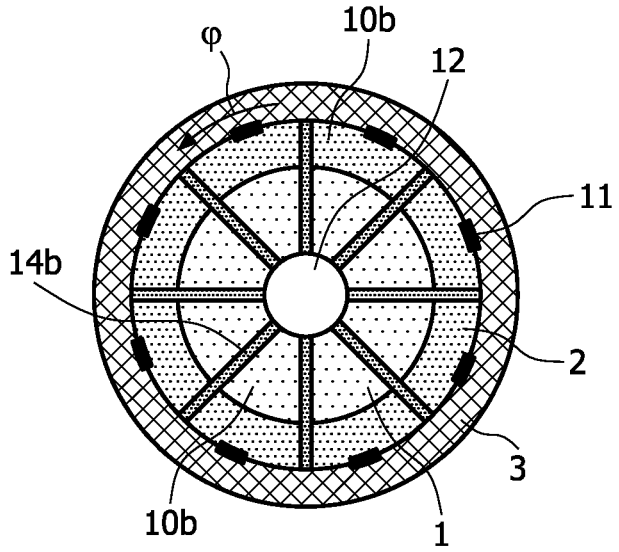
FIG. 10 shows a radial cross sectional view of the rotary anode disk profile according to a still further exemplary embodiment of the present invention, characterized by a flexible heat conductor and a sliding radial connection between the anode disk and the anode's rotary shaft.
Figure 10:
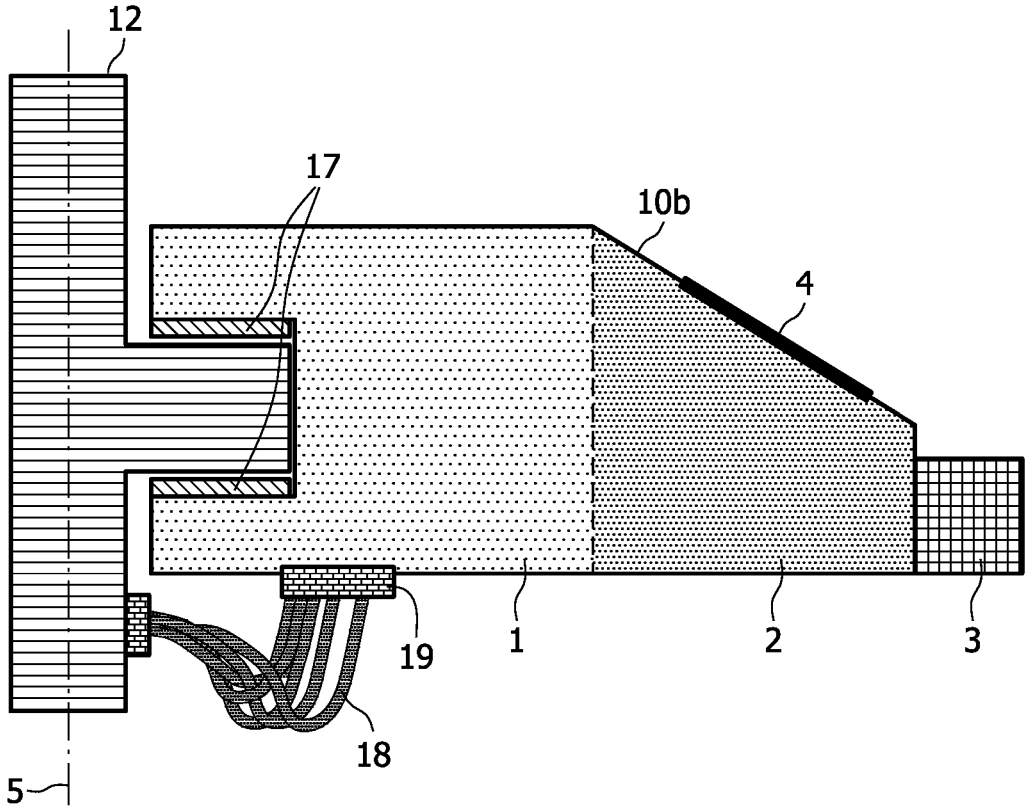

In FIGS. 8 to 10, three exemplary embodiments of the present invention are shown, whereupon flexibility for thermo-mechanical "breathing" is provided by S-shaped slit structures (first embodiment), a liquid metal heat conductor (second embodiment) and a flexible heat conductor (third embodiment).

A first one of these three exemplary embodiments of the present invention proposes a segmented high speed anode with a plurality of segments which are defined by S-shaped slits between the particular anode segments. According to this embodiment, said anode segments are only partially connected with the outer frame section. Localized joints between segments and outer frame section are used to allow the segments to expand azimuthally without inducing additional thermo-mechanical azimuthal forces in the outer frame section. This results in a conversion of radial heat expansion to torsion. Azimuthal S-shape angle $\phi_1$, which ranges from the azimuthally outermost point in $+\phi$-direction of an S-shaped slit to the azimuthally outermost point of the same slit in $-\phi$-direction is thereby chosen as being greater than slit spacing angle $\phi_0$, which is defined as the azimuthal angle between the radially outermost point of a first slit limiting an anode segment in $+\phi$-direction to the radially outermost point of a further, adjacent slit limiting the corresponding anode segment in $-\phi$-direction, so as to ensure that radial forces are minimized. Difference angle $\Delta\phi=\phi_1-\phi_0$ has a magnitude which is given such that heat conduction from positions between the inner radius $r_0$ of the inner anode bulk and the outer radius $r_2$ of the aforementioned slit anode segments adjacent to the outer frame section is maximized and the distortion of the segments (to be more precisely, the point of enhanced bending) is minimized. The number N of said slits is thus given by $N=360°/\phi_0$.

A second one of said three exemplary embodiments, which is depicted in FIG. 9, is directed to a high-speed rotary anode disk with a liquid metal heat conductor, which provides a liquid metal connection between the anode and the anode axis. This results in radial heat conduction and forceless expansion of the anode disk.

A third one of these three exemplary embodiments of the present invention, which is depicted in FIG. 10, is directed to a high-speed rotary anode disk with a sliding radial connection between the anode disk and the anode's rotary shaft, wherein said connection is realized in form of a flexible heat conductor that may e.g. be given by a copper wire. This consequently leads to the advantage of avoiding radial heat-induced forces.

APPLICATIONS OF THE PRESENT INVENTION

The present invention can be applied for any field of X-ray imaging, especially in those cases where very fast acquisition of images with high peak power is required, such as e.g. in the field of X-ray based material inspection or in the field of medical imaging, e.g. in cardiac CT or in other X-ray imaging applications which are applied for acquiring image data of moving objects in real-time.

While the present invention has been illustrated and described in detail in the drawings and in the foregoing description, such illustration and description are to be considered illustrative or exemplary and not restrictive, which means that the invention is not limited to the disclosed embodiments. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Any reference signs in the claims should not be construed as limiting the scope of the invention.

TABLE OF USED REFERENCE NUMBERS OR SIGNS AND THEIR MEANING

| | |
|---|---|
| 1 | inner frame section of the rotary anode (also referred to as inner anode bulk), made of at least one anisotropic high specific strength material with high thermal stability ("frame material") |
| 2 | region of the rotary anode adjacent to the focal track, made of a light-weight (not reinforced) material with high thermal conductivity and high thermal stability ("thermal material") |
| 2a | focal spot on the anode disk surface (in FIG. 8 shown while slit) |
| 3 | outer frame section of the rotary anode, made of at least one anisotropic high specific strength material with high thermal stability ("frame material"), which may be different from materials used for section 1 |
| 4 | coating layer for the focal track, made of a material with high X-ray yield (e.g. containing a high percentage of tungsten as a "track material") |
| 5 | rotational axis of the rotary anode disk |
| 6 | additional region of the rotary anode disk, made of at least one material of type "frame material" |
| 7 | electron beam impinging on the focal track of the anode |
| 8 | X-ray emission towards the X-ray window of the X-ray tube |
| 9 | additional region, made of at least one material of type "frame material", which is introduced in region 2 at the borders of the resulting segments and used to reinforce the segment structure |
| 10a | anode segment, confined by S-shaped slits |
| 10b | anode segment, confined by straight radial slits |
| 11 | localized joints of an S-shaped segment 10a to region 3 |
| 12 | rotary shaft of the anode, which acts as a heat sink |

-continued

| TABLE OF USED REFERENCE NUMBERS OR SIGNS AND THEIR MEANING | |
|---|---|
| 13 | point of enhanced bending |
| 14a | S-shaped slit (gap) between two anode segments 10a |
| 14b | straight radial slit (gap) between two anode segments 10b |
| 14c | slits going from the outer edge of the rotary anode disk to the inner anode bulk 1 |
| 15 | liquid metal seal, e.g. given by non-wetting surfaces |
| 16a | liquid metal conductors, shown in a state where the anode is rotating |
| 16b | liquid metal reservoir shown in a state where the rotary anode is at rest |
| 17 | sliding elements, mounted between a flange-like, protruding part of the rotary shaft 12 and the inner frame section 1 of the rotary anode |
| 18 | flexible heat conductor (e.g. made of at least one copper wire) connecting the inner frame section 1 of the rotary anode with the rotary shaft 12 of the rotary anode via joints 19 attached to the outer surfaces of the inner frame section 1 and the rotary shaft 12 |
| 19 | joint between the flexible heat conductor 18 and the inner frame section 1 of the rotary anode |
| $\alpha$ | radial declination angle of region 2 |
| $\phi$ | rotational angle of the rotary anode |
| $\phi_0$ | azimuthal slit spacing of the segmented anode disk, which is defined as the azimuthal angle between the radially outermost point of a first slit limiting an anode segment in $+\phi$-direction to the radially outermost point of a further, adjacent slit limiting the corresponding anode segment in $-\phi$-direction |
| $\phi_1$ | azimuthal covering angle of a single S-shaped slit, which ranges from the azimuthally outermost point in $+\phi$-direction of an S-shaped slit to the azimuthally outermost point of the same slit in $-\phi$-direction |
| $\Delta\phi$ | difference angle of $\phi_1$ and $\phi_0$ |
| $r_0$ | the outer radius of rotary shaft 12 and, simultaneously, the inner radius of inner frame section 1 of the rotary anode |
| $r_1$ | the outer radius of inner frame section 1 and, simultaneously, the inner radius of region 2 of the rotary anode |
| $r_2$ | the outer radius of region 2 and, simultaneously, the inner radius of outer frame section 3 of the rotary anode |
| $r_3$ | the outer radius of outer frame section 3 of the rotary anode |

The invention claimed is:

1. A rotary anode for an X-ray device, the rotary anode comprising:

a disk-shaped frame material having a radially-centered opening for a rotary shaft;

a rotary shaft within the opening;

a disk-shaped thermal material extending radially from the disk-shaped frame material;

a coating layer material for a focal track on a surface of the thermal material;

a first connector joint slidably attached to the disk-shaped frame material;

a second connector joint on the rotary shaft; and a flexible heat conductor connecting the first connector joint on the disk-shaped frame material to the second connector joint on the rotary shaft.

2. The rotary anode according to claim 1, wherein the frame material is selected from fiber-reinforced ceramics, carbon fiber-reinforced carbon, silicon carbide fiber-reinforced silicon carbide and reinforced ceramic materials.

3. The rotary anode according to claim 1, wherein the thermal material is a graphite material which has high thermal conductivity.

4. The rotary anode according to claim 1, wherein the rotary anode is symmetric with respect to the rotational plane of the rotary anode.

5. The rotary anode according to claim 1, wherein the rotary anode has a non-constant, decreasing profile thickness in a radial direction.

6. The rotary anode according to claim 1, wherein the rotary anode comprises an additional region that is made of a frame material in a section adjacent to the focal track.

7. The rotary anode according to claim 1, wherein the frame material is shaped as a spoke wheel.

8. The rotary anode according to claim 1, wherein the rotary anode has radial slits.

9. The rotary anode according to claim 1, further comprising a disk-shaped frame material extending radially outward from at least a portion of the disk-shaped thermal material.

10. The rotary anode according to claim 1, wherein the rotary anode is divided into distinct anode segments, wherein adjacent anode segments are separated by straight radial or S-shaped slits.

11. The rotary anode according to claim 1, further comprising liquid metal conductors between the disk-shaped frame material and the rotary shaft which provide a liquid metal connection between the frame material and its rotary shaft.

12. The rotary anode according claim 1, wherein said flexible heat conductor is a single copper wire or a bundle of different copper wires.

13. An X-ray device comprising a rotary anode according to claim 1.

14. A computed tomography device comprising an X-ray tube according to claim 13.

* * * * *